United States Patent [19]

Iijima et al.

[11] Patent Number: 4,491,627

[45] Date of Patent: Jan. 1, 1985

[54] LIGHT-SENSITIVE SILVER HALIDE PHOTOGRAPHIC MATERIAL WITH MICROCAPSULES THAT DISSOLVE AT PH OF AT LEAST 7

[75] Inventors: Toshifumi Iijima; Shigeharu Koboshi; Hiroshi Yamazaki, all of Hino, Japan

[73] Assignee: Konishiroku Photo Industry Co., Ltd., Tokyo, Japan

[21] Appl. No.: 456,780

[22] Filed: Jan. 10, 1983

[30] Foreign Application Priority Data

Jan. 20, 1982 [JP] Japan ..... 57-7972

[51] Int. Cl.[3] ..... G03C 1/06; G03C 1/42

[52] U.S. Cl. ..... 430/138; 430/566

[58] Field of Search ..... 430/138, 566

[56] References Cited

U.S. PATENT DOCUMENTS

| | | | |
|---|---|---|---|
| 3,301,439 | 1/1967 | Kosar et al. | 430/138 |
| 3,468,662 | 9/1969 | McCune | 430/138 |
| 3,523,907 | 8/1970 | Urancken et al. | 430/138 |
| 3,645,911 | 2/1972 | Van Besauw et al. | 430/138 |
| 3,714,065 | 1/1973 | Kitajima et al. | 430/138 |

*Primary Examiner*—Richard L. Schilling

*Attorney, Agent, or Firm*—Frishauf, Holtz, Goodman & Woodward

[57] ABSTRACT

There is disclosed a light-sensitive silver halide photographic material comprising at least one hydrophilic colloid layer containing microcapsules encapsulating a photographic treating reagent coated with a wall material, which can be dissolved at pH 7 or higher, provided on a support.

The microcapsules of the present invention, can be effectively employed in a one-bath treatment method for forming a dye image. The bath is highly stable and the resulting images have extremely high color density.

20 Claims, No Drawings

LIGHT-SENSITIVE SILVER HALIDE PHOTOGRAPHIC MATERIAL WITH MICROCAPSULES THAT DISSOLVE AT PH OF AT LEAST 7

This invention relates to a light-sensitive silver halide photographic material including photographic treating reagents.

Formation of color images in light-sensitive color photographic materials is generally completed by following the respective processes of color developing, bleaching and fixing. In the color developing process a light-sensitive silver halide material having been exposed to light is developed with the use of a developing agent of an aromatic primary amine in the presence of a coupler capable of forming a dye through the reaction with an oxidized product of the developing agent, whereby an azomethyne or indoaniline dye is formed. In this color developing step, an aromatic primary amine developing agent is generally dissolved in an aqueous alkali solution and provided for use as a color developing solution. And, in many cases, auxiliary treatments such as water washing, film hardening and others may be applied before and after respective processes as mentioned above. This method involves many processes and will take disadvantageously a long time for the treatments.

On the other hand, because a color developing solution is unstable and may be changed in the composition the developing solution during storage, thus being difficult to take care of, methods have recently been proposed in which developing agents are to be incorporated in light-sensitive silver halide materials. Inclusion of a developing agent within a light-sensitive material leads to simplification of the compositions of treating solutions, whereby not only the aforementioned care of a developing agent is made easier, but also developing can be carried out with an alkali bath alone. Therefore, since a number of advantages can be expected in making the treatments simplified and more rapid, it is strongly desired to have such a method put into practical application.

Various methods have also been made for making shorter the treatment time. For example, one method is elevation of the treatment temperature. Further, silver bleaching and fixing may be performed in one bath by using a ferric ion complex as an oxidizing agent in combination with a fixing agent. This is practically used under the name of the one-bath bleaching fixing bath.

Generally speaking, however, inclusion of an aromatic primary amine developing agent within a light-sensitive material has not yet been practiced in the art due to the disadvantages of reduction in sensitivity, fog or contamination, which are liable to occur during storage of light-sensitive materials and further due to insufficient color image density effected.

With regard to monochromatic developing agents such as catechol or hydroquinone, for example, U.S. Pat. No. 3,295,978 discloses a method in which they are included in the form of metal salts, whereby it is possible to include these developing agents relatively stably within light-sensitive materials.

In case of an aromatic primary amine color developing agent, inclusion thereof within a light-sensitive material is more difficult due to its instability. In the prior art, the method of incorporating an aromatic primary amine color developing agent in a light-sensitive material in stable form, namely as a precursor thereof, is known by the disclosures as mentioned below.

For example, in U.S. Pat. No. 3,342,599, there is employed a Schiff base with salicylaldehyde as a color developing agent precursor, while in U.S. Pat. No. 3,719,492, it is employed in the form of a reaction product with a metal salt such as of lead, cadmium, etc. Also, in U.K. Pat. No. 1,069,061, phthalimide compounds are used which are obtained by the reaction between aromatic primary amines and phthalic acids. Further, in Japanese Provisional Patent Publications No. 135628/1978 and No. 79035/1979, there are employed an aromatic primary amine developing agent obtained by converting a primary amine to a carbamate derivative.

In addition, German Pat. Nos. 1,159,758 and 1,200,679 also disclose precursors.

However, when the developing agent precursors as disclosed in the aforesaid patent specifications are incorporated in light-sensitive material, such light-sensitive materials may be accompanied by the occurrence of sensitivity reduction, fog or contamination during storage, and moreover no image of high color density can be obtained. Under the present situation, these various drawbacks are not yet solved.

On the other hand, the idea of one-bath treatment may be extended so far that a color developing agent, a silver bleaching agent and a fixing bath are made into one bath, whereby it may be expected that the process can be only one to give a great effect of simplification of operation. However, the co-presence of a developing agent which is very susceptible to oxidation and a bleaching agent which is one of oxidizing agents is a paradox.

As an attempt at one-bath treatment of the prior art, for example, Japanese Provisional Patent Publication No. 5424/1974 discloses a method to obtain a color image by use of one treatment bath containing 1-phenyl-3-pyrazolidone, a color developing agent, a silver bleaching agent and a fixing agent. In this method, storability of the treating solution is also very poor due to co-presence of readily oxidizable 1-phenyl-3-pyrazolidone and a color developing agent with a silver bleaching agent, and further the iron (III) complex ions used as a silver bleaching agent are very unstable in an alkali solution tending to form precipitates of ferric hydroxide. For these drawbacks, practical application of this method is very difficult. Also, in Japanese Provisional Patent Publication No. 102340/1974, there is disclosed a one-bath treatment method by using a cobalt (III) complex ion as a silver bleaching agent. This method, similarly as the technique disclosed in the aforesaid Japanese Provisional Patent Publication No. 5424/1974, involves a similar drawback due to the co-presence of a color developing agent with a silver bleaching agent. Further, as another drawback, the co-presence of both will markedly retard the color developing speed as compared with the bleaching fixing speed, whereby no sufficient color density can be obtained, and it is difficult to obtain a desired photographic performance even by use of a color accelerator such as 1-phenyl-3-pyrazolidone in combination.

Accordingly, an object of this invention is to provide a stable light-sensitive silver halide photographic material containing photographic treating reagents improved in occurrence of sensitivity reduction, fog and contamination. Other objects of this invention will be apparent as the description proceeds in the specification. The present inventors have found that the object of this invention can be accomplished by a light-sensitive silver halide photographic material, comprising at least one hydrophilic colloid layer containing microcapsules encapsulating a photographic treating reagent as a core material coated with a wall material, which can be dissolved at pH 7 or higher, provided on a support.

According to a preferred embodiment of this invention, the above treating reagent is a reducing agent. More preferably, said reducing agent may be a developing agent or a precursor thereof. More preferably, said developing agent or a precursor thereof may be an aromatic primary amine color developing agent or a precursor thereof.

According to another preferred embodiment of this invention, the above treating reagent is an oxidizing agent. More preferably, said oxidizing agent may be a cobalt (III) complex. More preferably, said cobalt (III) complex may be a coordinated complex of cobalt having ligands selected from the group consisting of ammine, ethylenediamine, diethylenetriamine, triethylenetetramine, nitrate, nitrite, azide, chloride, thiocyanate, isothiocyanate, sepulchrate, water and carbonate, said complex having at least five amine ligands or at least two ethylenediamine ligands.

According to still another embodiment of this invention, the above treating reagent is a silver halide solvent.

Typical examples of color developing agents of reducing agents which can be applied advantageously as reducing agents for core materials may include color developing agents employed for use in developing light-sensitive silver halide color photographic materials. For example, there may be employed color developing agents, aromatic primary amines such as p-phenylenediamine and p-aminophenol, disclosed in Research Disclosure Vol. 176, No. 17643, December, 1978 (referred to hereinafter as Literature 1). As precursors of color developing agents, there may be employed Schiff base type of color developing agents as disclosed in U.S. Pat. Nos. 2,507,114, 2,695,234 and 3,342,599 and Research Disclosure Vol. 151, No. 15159, November, 1979, and precursors of color developing agents as disclosed in Research Disclosure Vol. 129, No. 12924, October, 1976, Vol. 121, No. 12146, June, 1974 and Vol. 139, No. 13924, November 1975.

The color developing agent and/or precursor thereof (the developing agent and precursor thereof are called hereinafter comprehensively as the developer) to be included by microencapsulation may be incorporated into an element generally in an amount equimolar to a coupler, but an amount larger or smaller than a stoichiometric amount may also be employed. The color forming developer of this invention may be used preferably in an amount of 0.15 to 1.5 mole per mole of silver halide.

In this invention, the cobalt (III) complex useful as a core material in microcapsules has a coordination number of 6 and has monodentate ligands or bidentate ligands selected from the ligands such as alkylenediamine, amine, bipyridine, 1,10-phenanthroline, urea, aquo, nitrate, nitrite, azide, chloride, thiocyanate, isothiocyanate, carbonate and other ligands commonly found in cobalt (III) complexes. Particularly useful are cobalt (III) complex salts comprising 4 or more amine ligands such as $[Co(NH_3)_6]X$, $[Co(NH_3)_5H_2O]X$, $[Co(NH_3)_5CO_3]X$, $[Co(NH3)_4CO_3]X$, and $[Co(NH_3)_5Cl]X$ (where X represents one or more anion groups determined by the law of charge neutralization). Examples of other useful cobalt (III) complex salts are shown below.

$[Co(en)_3]X$, cis-$[Co(en)_2(N_3)_2]X$, trans-$[Co(en)_2Cl(SCN)]X$, trans-$[Co(en)_2(N_3)_3]X$, cis-$[Co(en)2(NH_3)_3N]X$, cis-$[Co(en)_2Cl_2]X$, trans-$[Co(en)_2Cl_2]X$, $[Co(en)_2(SCN)_2]X$, $[Co(en)_2(SCN)_2]X$, $[Co(tn)_3]X$, $[Co(tn)_2(en)]X$, $[Co(tn)(en)_2]X$, $[Co(bpy)_3]X$, $[Co(phen)_3]X$, $[Co(salen)(NH_3)_2]X$ and $[Co(sal)(NH_3)_4]X$ (where X has the same meaning as defined above, "en" represents ethylenediamine, "tn" propylenediamine, "bpy" bipyridine, "phen" 1,10-phenanthroline, "salen" N,N-disalicylideneethylenediamine and "sal" salicylic acid).

There may also be employed metal complexes having coordinated sepulchrate ligands as disclosed in Japanese patent application Nos. 56698/1981 and 58780/1981. The content of a cobalt (III) complex, when contained in a color photographic element, may be at least a concentration of 10 g based on cobalt per mole of silver, preferably 0.075 to about 4.0 mole per mole of silver, and, when contained in an aqueous alkali solution, 0.2 to 20 g, preferably 0.4 to 10 g, per liter of an aqueous alkali solution.

As an oxidizing agent, it is also possible to use a ruthenium (III) complex disclosed in U.S. Pat. No. 3,901,712.

A peroxide may be used as an oxidizing agent for a core material in microcapsules.

The peroxide to be used as a core material in microcapsules of this invention may take any convenient conventional form. In general, a water soluble compound containing a peroxy group (—O—O—) may preferably be used as a peroxide. For example, there may be included, inorganic peroxide compounds or salts of peracids such as perborate, percarbonate or persilicate. Particularly, hydrogen peroxide is highly active and therefore may preferably be used. It is also possible to use organic peroxides such as benzoyl peroxide, percarbamide, adducts of hydrogen peroxide with aliphatic acid amides, polyalcohols, amines, acyl-substituted hydrazine, and others. Peroxides may be used preferably in amounts of 0.001 mole to 0.5 mole per one liter of silver halide emulsion (containing 60 g of silver nitrate).

The silver halide solvent to be used in this invention is an ordinary silver halide solvent, which is a compound which can dissolve 10 times as much as the amount (by weight) of a silver halide which can be dissolved in water 60° C., when employed in an aqueous solution (60° C.).

Typical examples of useful silver halide solvents may include water soluble thiosulfates (e.g., sodium thiosulfate, potassium thiosulfate, ammonium thiosulfate, etc.), thiourea, ethylenethiourea, water soluble thiocyanates (e.g., sodium thiocyanate, potassium thiocyanate and ammonium thiocyanate), water soluble sulfur containing diols, and water soluble sulfur containing dibasic acids. Water soluble diols which can advantageously be used are those represented by general formula:

$$HO(CH_2CH_2Z)_pCH_2CH_2OH$$

wherein p is an integer of 2 to 13, Z represents an oxygen atom or a sulfur atom, at least $\frac{1}{3}$ of the Z atoms being sulfur, and there are at least two continuous Z's in the structure of this compound, which are sulfur atoms.

Another group of useful diols may be represented comprehensively by general formula:

$$HO-(CH_2CH_2X)_{c-1}(CH_2CH_2X')_{d-1}(CH_2CH_2X)_{e-1}(CH_2CH_2X')_{f-1}(CH_2CH_2X)_{g-1}CH_2CH_2OH$$

wherein X and X' represent oxygen or sulfur, and when X represents oxygen, X' represents sulfur, and vice versa; each of c, d, e, f and g is an integer of 1 to 15, and the total of c+d+e+f+g is an integer of 6 to 19; at least $\frac{1}{3}$ of the total of X and X' represent sulfur atoms; and there are at least two continuous X and/or X' which represent sulfur atoms in the structure of the compound.

Typical examples of diols include the following compounds:

(1) 3,6-dithia-1,8-octanediol
$HOCH_2CH_2SCH_2CH_2SCH_2CH_2OH$ (2) 3,6,9-trithia-1,11-undecanediol
$HOCH_2CH_2SCH_2CH_2SCH_2CH_2SCH_2CH_2OH$ (3) 3,6,9,12-tetrathia-1,14-tetradecanediol
$HO(CH_2CH_2S)_4CH_2CH_2OH$ (4) 9-oxo-3,6,9,12,15-tetrathia-1,17-heptadecanediol
$HO(CH_2CH_2S)_2CH_2CH_2O(CH_2CH_2S)_2CH_2CH_2OH$ (5) 9,12-dioxa-3,6,15,18-tetrathia-1,20-eicosanediol
$HO(CH_2CH_2S)_2(CH_2CH_2O)_2(CH_2CH_2S)_2CH_2CH_2OH$ (6) 3,6-dioxa-9,12-dithia-1,14-tetradecanediol
$HO(CH_2CH_2O)_2(CH_2CH_2S)_2CH_2CH_2OH$ (7) 3,12-dioxa-6,9-dithia-1,14-tetradecanediol
$HOCH_2CH_2O(CH_2CH_2S)_2CH_2CH_2OCH_2CH_2OH$ (8) 3,18-dioxa-6,9,12,15-tetrathia-1,20-eicosanediol
$HOCH_2CH_2O(CH_2CH_2S)_4CH_2CH_2OCH_2CH_2OH$ (9)12,18-dioxa-3,6,9,15,21,24,27-heptathia-1,29-nonacosanediol
$HO(CH_2CH_2S)_3CH_2CH_2OCH_2CH_2SCH_2CH_2O(CH_2CH_2S)_3CH_2CH_2OH$

(10) 6,9,15,18-tetrathia-3,12,21-trioxo-1,23-tricosanediol
$HOCH_2CH_2O(CH_2CH_2S)_2CH_2CH_2O(CH_2CH_2S)_2CH_2CH_2OCH_2CH_2OH$ Usable water soluble sulfur containing dibasic acids include those having the following formula:

$$HOOCCH_2-(SCH_2CH_2)_qSCH_2COOH$$

(q is an integer of 1 to 3),
and also include alkali metal salts and ammonium salts of the acids having the above formula. Typical examples are enumerated below.

(1) Ethylene-bis-thioglycolic acid
$HOOCCH_2SCH_2CH_2SCH_2COOH$ (2) 3,6,9-trithiahendecanedioic acid
$HOOCCH_2(SCH_2CH_2)_2SCH_2COOH$ (3) 3,6,9,12-tetrathiatetradecanedioic acid
$HOOCCH_2(SCH_2CH_2)_3SCH_2COOH$ (4) Disodium ethylene-bis-thioglycolate (5) Dipotassium ethylene-bis-thioglycolate (6) Diammonium ethylene-bis-thioglycolate (7) Disodium 3,6,9-trithiahendecanedioate (8) Disodium 3,6,9,12-tetrathiatetradecanedioate When a silver halide solvent is to be included by microencapsulation, its content may appropriately be equimolar to silver halide or higher, preferably 2 to 5 equivalents relative to silver halide.

In this invention, examples of photographic treating reagents to be included by microencapsulation are not limited to those as mentioned above, but other reagents such as p-methylaminophenol sulfate, hydroquinone and phenidone as well as derivatives thereof, sulfites, hydroxylamine salts (e.g., hydroxylamine sulfate) may be also employed.

As the wall material for the microcapsules to be used in this invention, there may preferably be employed a polymer which can be dissolved at pH 7 or higher, preferably at pH 8 or higher.

Such a wall film of an alkali soluble polymer may either be dissolved during the developing treatment process to be dissolved out of the light-sensitive silver halide photographic material or not. Preferably, it should not be dissolved out.

In this invention, as the polymer advantageously used as the wall material for microcapsules, there may be included polymeric compounds such as vinyl polymers having pendant carboxyl groups or sulfonic acid groups, condensation type polymeric compounds, etc. For example, vinyl polymers may include copolymers of monomers having pendant carboxylic groups or sulfonic acid groups such as methacrylic acid, acrylic acid, vinyl sulfonic acid, etc. with monomers such as methacrylates (e.g., methyl methacrylate, ethyl methacrylate), styrenes (e.g., styrene, α-methyl styrene), vinyl ketones (e.g., vinyl methyl ketone), etc. [the weight ratio of the monomer having pendant carboxylic group or sulfonic acid group to other monomers being preferably 40:60 to 70:30]. Condensation type polymeric compounds may include condensates of lysine with polycarboxylic acid chlorides such as terephthaloyl chloride, adipic acid chloride, sebacic acid chloride, etc. Other than these, there may also be employed carboxyl containing cellulose derivatives having carboxylic groups in the molecules.

Specific examples of polymers to be used advantageously as the wall material for microcapsules to be used in this invention are vinyl type polymers having carboxylic groups or sulfo groups or salts thereof, including copolymers of acrylic acid, acrylate or methacrylic acid with acrylate or methacrylate such as methacrylic acid (MAA)-methyl methacrylate (MMA) copolymers [MAA/MMA=40/60~70/30 (weight %)], methyl acrylate (MA)−ethyl methacrylate (EMA) copolymers [MA/EMA=40/60~70/30 (weight %)], vinyl sulfonic acid-methacrylate copolymers, etc.; condensation type polymers having carboxylic groups in the molecules such as condensates of lysine with acid chlorides such as terephthaloyl chloride, etc. and other polymers such as cellulose derivatives having carboxylic groups in the molecules.

The wall material for microcapsules according to this invention may have a film thickness which can be freely varied depending on the solubility of the wall material and the purpose. For example, for prevention of sensitivity reduction during storage or for prevention of retardation of developing treatment time, the film thickness may be selected as desired. It is also possible to vary the film thickness of the wall material depending on the purpose, for example, for controlling the time for the action of such functions as of an oxidizing agent, a reducing agent of the core material, etc.

The effect of the photographic treating reagents of these core materials can be controlled not only by the film thickness of the wall material but also by use of polymers selected having different dissolution rates.

The microcapsules according to this invention may be shaped in any of spheres, cubes, columns, needles, plates and mass. Preferably, they may be shaped in uniform spheres.

The microcapsules according to this invention may have a mean particle size of 10μ or less, more preferably 5μ or less, further preferably 1μ or less, most preferably 0.5μ or less.

Next, preparation of microcapsules to be used in this invention is to be described.

The methods for preparation of microcapsule particles may be classified broadly into two categories. One is an interfacial polymerization by use of emulsification such as electric emulsification, and the other is so-called micell polymerization in which polymerization is carried out after formation of micells. In including the core materials, it is not always possible to apply both methods for all of the core materials. That is, according to the interfacial polymerization, core materials which can readily react with acid chlorides cannot be encapsulated, while no core substance inhibiting a radical reaction can be used in the micell polymerization method.

Preferable examples of combinations of core materials and preparation methods are shown below.

| | |
|---|---|
| Developing agent | Micell polymerization |
| Developing agent precursor | Micell polymerization, Interfacial polymerization |
| Co (III) complex | Micell polymerization |
| Hypo | Interfacial polymerization |
| Peroxide | Interfacial polymerization |

For other core materials, the optimum method can be selected in view of the above.

As the method for preparation of microcapsules, there may be advantageously used the micell polymerization methods by P. Speiser et al. as described in G. Birren bach, P. P. Speiser, Journal of Pharmaceutical Sciences, 65 (12) p. 1763~1766 (1976), P. Tulkens, M. Roland, A. Trouet, P. Speiser, F. E. B. S. Letters, 84 (2) p. 323 (1977), P. Courreur or the interfacial polymerization methods by electric emulsification as described in A. Watanabe, K. Higashitsuji, K. Nishizawa, Journal of Colloid and Interface Science, 64 (2) p. 278 (1978), M. Arakawa, T. Kondo, Canadian Journal of Physiology and Pharmacology, 58 (2) p. 183 (1980).

In the light-sensitive material of this invention, the microcapsules are contained in at least one layer of hydrophilic colloid layers containing light-sensitive silver halide emulsions on the same side as the light-sensitive silver halide emulsion layer on a support. That is, the layer containing microcapsules may be a light-sensitive silver halide emulsion layer, a non-sensitive hydrophilic colloid layer such as a protective layer, an intermediate layer or a subbing layer, and they may be contained in any of the non-sensitive hydrophilic coloid layer nearest to the support, the non-sensitive hydrophilic colloid layer farthest from the support or non-sensitive hydrophilic colloid layers on both sides of the light-sensitive silver halide emulsion layer. However, microcapsules may preferably be contained in a light-sensitive silver halide emulsion layer. When they are to be contained in a non-sensitive hydrophilic colloid layer, said layer may preferably be a non-sensitive hydrophilic colloid layer adjacent to a light-sensitive silver halide emulsion layer.

In this invention, for incorporation of microcapsules in a hydrophilic colloid layer, the microcapsules prepared may be added into a coating composition of said hydrophilic colloid layer to be uniformly dispersed therein, followed by coating of the resultant dispersion. The content of microencapsulated photographic treating reagents other than those as described above may also be readily determined experimentally by referring to the above description.

In the photographic emulsion layer of the light-sensitive photographic material according to this invention, there may be included as silver halide any of those conventionally used in silver halide photographic emulsions such as silver chloride, silver bromide, silver iodide, silver chlorobromide, silver iodobromide, silver chloroiodobromide, etc. and they can be prepared by the methods known in the art.

The silver halide photographic emulsion having silver halide grains as described above dispersed in a binder solution can be sensitized with a chemical sensitizer. The chemical sensitizers which can advantageously be used in combination may be classified broadly into the four kinds of noble metal sensitizers, sulfur sensitizers, selenium sensitizers and reductive sensitizers.

As noble metal sensitizers, there may be employed gold compounds and compounds of ruthenium, rhodium, palladium, iridium, platinum, etc.

When a gold compound is used, it is further possible to use ammonium thiocyanate, sodium thiocyanate in combination.

As sulfur sensitizers, other than active gelatins, there may be employed sulfur compounds.

As selenium sensitizers, there may be employed active and inactive selenium compounds.

As reductive sensitizers, there may be employed monovalent tin salts, polyamines, bisalkylaminosulfides, silane compounds, iminoaminomethane sulfinic acid, hydrazinium salts, hydrazine derivatives, etc.

As sensitizing dyes, various kinds of dyes can be employed. The sensitizing dyes advantageously employed in this invention may include well-known methyne dyes such as cyanine, melocyanine, hemicyanine, rhodacyanine, oxonol, hemioxonol, etc. and styryl dyes. These sensitizing dyes may be used either singly or as a combination of two or more kinds.

The optimum concentration of the sensitizing dye to be used in this invention may be determined according to the method known to those skilled in the art.

The amount of the sensitizing dye to obtain enhanced color sensitization in this invention is not particularly limited, but advantageously within a range from about $2\times10^{-6}$ mole to about $1\times10^{-3}$ mole per mole of silver halide. Particularly, the range from $5\times10^{-6}$ mole to $1\times10^{-5}$ mole is advantageous.

In this invention, it is also possible to incorporate in the silver halide emulsion layer stabilizers conventionally used, such as 4-hydroxy-6-methyl-1,3,3a,7-tetrazaindene, 4-hydroxy-cyclopentano[f]-1,3,3a,7-tetrazaindene, 5-phenyl-1-mercaptotetrazole, 2-mercaptobenzothiazole, etc.

Further, in the silver halide emulsion, there may be employed developing accelerators such as polyalkylene oxides and derivatives thereof, quaternary ammonium salt compounds, 1,4-thiazine derivatives, pyrrolidine derivatives, urethanes, urea type compounds, thiourea type compounds, imidazole or imidazoline derivatives, and onium salts of phosphorus or sulfur as disclosed in U.S. Pat. No. 2,288,226.

The hydrophilic colloid layer (including a photographic emulsion layer) of the light-sensitive material of this invention may also contain a surfactant either as a single species or as a mixture.

As surfactants, there may be employed as coating aids, emulsifiers, agents for improvement of permeability of treating solutions, etc., defoaming agents, antistatic agents, anti-adhesion agents, materials for improvement of photographic characteristics or control of physical properties, various surfactants, including natural products such as saponin; nonionic surfactants such as alkylene-oxide type, glycerine type, glycidal type, etc.; cationic surfactants such as higher alkyl amines, pyridine and other heterocyclic rings, quaternary nitrogen onium salts, phosphoniums or sulfoniums; anionic surfactants containing acidic groups such as carboxylic acids, sulfonic acids, phosphoric acids, sulfate esters or phosphate esters; and amphoteric surfactants such as amino acids, aminosulfonic acids, etc.

Hardening treatment of the hydrophilic colloid layer may be practiced in a conventional manner. As the hardeners, there may be employed conventional hardeners for photography, including, for example, aldehyde type compounds such as formaldehyde, glyoxal, glutaraldehyde or derivatives thereof such as acetals or bisulfite sodium adducts; mehtanesulfonate ester type compounds; mucochloric acid or mucohalogenic acid type compounds; epoxy type compounds; aziridine type compounds; active halide type compounds; maleic acid imide type compounds; active vinyl compounds; carbodiimide type compounds; isooxazole type compounds; N-methylol type compounds; isocyanate type compounds; inorganic hardners such as chromium alum, zirconium sulfate, etc.

The hydrophilic colloid layer can also incorporate, other than those mentioned above, additives having various functions for enhancement of the quality of light-sensitive photographic materials, such as plasticizers, antistatic agents, UV-absorbers, antioxidants, etc.

When the light-sensitive silver halide material of this invention is made for color, couplers conventionally used may be incorporated in the light-sensitive material. That is, as diffusion resistant magenta couplers, there may be employed pyrazolotriazole type, pyrazolinobenzimidazole type, indazolone type and pyrazolone type compounds. Pyrazolone type magenta couplers may include those disclosed in U.S. Pat. Nos. 2,600,788, 3,062,653, 3,127,269, 3,311,476, 3,419,391, 3,519,429, 3,558,318, 3,684,514 and 3,888,680; Japanese Provisional Patent Publication Nos. 29639/1974, 111631/1974, 129538/1974, 13041/1975, 105820/1976, 58533/1977 and 80027/1977. Pyrazolotriazole type magenta couplers may include the compounds disclosed in U.K. Pat. No. 1,247,493 and Belgian Pat. No. 792,525. As pyrazolinobenzimidazole type magenta couplers, there may be employed the compounds disclosed in U.S. Pat. No. 3,061,432, German Pat. No. 2,156,111 and Japanese Patent Publication No. 60479/1971. Further, as indazolone type magenta couplers, there may be used the compounds disclosed in Belgian Pat. No. 769,116.

As diffusion resistant yellow couplers, there may be employed well-known opened kethomethylene compounds, such as benzoylacetanilide type yellow couplers, pivaloylacetanilide type yellow couplers. More preferably, there may be employed diequivalent type yellow couplers of which the carbon atoms at the coupling position are substituted with substituents releasable at the time of coupling reaction. These examples are disclosed in U.S. Pat. Nos. 2,875,057, 3,265,506, 3,664,841, 3,408,194, 3,447,928, 3,277,155 and 3,415,652; Japanese Patent Publication No. 13576/1974; Japanese Provisional Patent Publication Nos. 29432/1973, 66834/1973, 10736/1974, 122335/1974, 28834/1975, 132926/1975, etc.

As diffusion resistant cyan couplers, phenol or naphthol derivatives may generally be used. Examples of these compounds are disclosed in U.S. Pat. Nos. 2,423,730, 2,474,293, 2,801,171, 2,895,826, 3,476,563, 3,737,316, 3,758,308 and 3,839,044; Japanese Provisional Patent Publication Nos. 37425/1972, 10135/1975, 25228/1975, 112038/1975, 117422/1975 and 130441/1975; U.S. Pat. Nos. 2,369,929, 2,474,293, 3,591,383, 2,895,826, 3,458,315, 3,311,476, 3,419,390, 3,476,563 and 3,253,924; U.K. Pat. No. 1,201,110; U.S. Pat Nos. 3,034,892, 3,386,301 and 2,434,272; etc.

In the light-sensitive material according to this invention, each of the diffusion resistant couplers may be used in an amount generally from $2\times10^{-3}$ mole to $5\times10^{-1}$ mole, preferably from $1\times10^{-2}$ mole to $5\times10^{-1}$ mole, per mole of silver in the light-sensitive silver halide emulsion layer.

When this invention is applied for a color negative film, a DIR compound may preferably be contained in the light-sensitive material from a point of view of color reproduction.

DIR compounds may be classified to those in which a component capable of reacting with an oxidized product of a color forming developing agent has directly a developing inhibiting component and those having a developing inhibiting component through a timing group. Preferable DIR compounds of the latter type are represented by the following formula (1).

Formula (1):

A—TIME—Z

In the above formula, A is a component which can react with an oxidized product of a color forming developing agent, and it may be any component, so far as it can liberate TIME—Z group by reacting with an oxidized product of a color forming developing agent.

TIME is a timing group and Z a component which inhibits development by being liberated from the TIME group. As the timing group, there may be mentioned those obtained by the intramolecular nucleophilic substitution reaction as disclosed in Japanese Provisional Patent Publication No. 145135/1979 or those obtained by the electron transfer along the conjugated chain as disclosed in Japanese Provisional Patent Publication No. 114946/1981. In short, any compound may be available which can first liberate a TIME—Z group through cleavage of the linkage of A—TIME and then liberate Z through cleavage of the linkage of TIME—Z. Z may include the development inhibitors as disclosed in Literature 1, preferably mercaptotetrazole, selenotetrazole, mercaptobenzothiazole, selenobenzothiazole, mercaptobenzoxazole, selenobenzoxazole, mercaptobenzimidazole, selenobenzimidazole, benzotriazole, benzodiazole and derivatives thereof.

On the other hand, preferable DIR compounds in which a component capable of reacting with an oxidized product of a color developing agent has directly an inhibiting component are represented by the formula (2) as shown below:

Formula (2):

B—Y

In the above formula (2), B is a component capable of reacting with an oxidized product of a color developing agent and liberates the Y group (development inhibiting component) through the reaction with an oxidized product of a color developing agent. As Y, there may be employed the development inhibiting component as shown in the formula (1).

The DIR compounds, of which components capable of reacting with oxidized products of color developing agents have directly inhibiting components, may include those as disclosed in U.S. Pat. Nos. 3,958,993, 3,961,959 and 3,938,996; Japanese Provisional Patent Publication Nos. 147716/1975, 152731/1975, 105819/1976, 6724/1976 and 46817/1977; U.S. Pat. Nos. 3,928,041, 3,227,554, 3,773,201 and 3,632,345; U.K. Pat. No. 2,010,818; and Japanese Provisional Patent Publication No. 49030/1977.

The group A in the aforesaid formula (1) and the group B in the formula (2) are inclusive of those which form dyes through the reaction with oxidized products of color developing agents and those which form no such dye.

As the method for dispersing a diffusion resistant coupler and a DIR compound, there may be employed various methods such as the so-called alkali aqueous solution dispersing method, solid dispersing method, latex dispersing method, oil-in-water type emulsifying method, which may be suitably selected depending on the chemical structure of a diffusion resistant coupler, etc. Among them, the latex dispersing method and the oil-in-water emulsifying method are particularly effective. These dispersing methods are well known in the art and the latex dispersing method and its effects are described in Japanese Provisional Patent Publication Nos. 74538/1974, 59943/1976 and 32552/1979, and Research Disclosure, No. 14850, pp. 77~79, August, 1976.

When this invention is applied for a multi-layer system light-sensitive color photographic material, the desirable sensitivity of each of a blue-sensitive silver halide emulsion layer, a green-sensitive silver halide emulsion layer and a red-sensitive silver halide emulsion layer to be used in the light-sensitive silver halide emulsion layer can be obtained by use of a sensitizing dye and a filter according to the conventional method known in the art. Each silver halide emulsion layer can be made to have a desired spectral wavelength sensitivity with the use of a filter layer known in this field of the art upon the emulsion layer subjected to said spectral sensitization. Each silver halide emulsion layer may incorporate an irradiation preventive dye therein.

An irradiation filter dye may contain one or more kinds of dyes. Also, UV-absorbers (compounds capable of absorbing potently the light with wavelengths of about 375 mμ or less) may be applicable according to the known methods. Any of UV-absorbers known in the art is useful, including UV-absorbers such as acenaphthenotriazoles disclosed in U.S. Patent No. 3,271,156; phenylbenzotriazole UV-absorbers disclosed in German Patent No. 1166623; UV-absorbers disclosed in U.S. Pat. No. 3,004,896; UV-absorbers disclosed in French Patent No. 1359924, U.S. Pat. Nos. 2,691,579, 2,719,086, U.S. patent application Ser. No. 567,070 and U.S. Patent No. 2,798,004. A particularly useful group of UV-absorbers are disclosed in Canadian Pat. No. 754,094. Further, other than the aforesaid additives, it is also possible to use various additives useful for photographic materials such as contamination preventive agents, lubricants and others.

The light-sensitive color photographic material for which this invention is applied may incorporate a compound conventionally used as a cross-oxidation agent for improvement of instability caused by a color developing agent. For example, there may be employed a monochromatic developing agent, particularly a 3-pyrazolidone compound and a hydroquinone compound.

The light-sensitive silver halide photographic material of this invention may optionally have auxiliary layers in addition to the silver halide emulsion layer such as a protective layer, an intermediate layer, a filter layer, a halation preventive layer, a backing layer, etc.

As the support, there may suitably be selected those known in the art such as plastic films, etc. depending on the purposes. These supports are generally applied with subbing treatments for reinforcement of adhesion with photographic emulsion layers.

The light-sensitive silver halide photographic material is applicable effectively for various light-sensitive silver halide photographic materials for X-ray, for color, for monochrome, for transfer, for high contrast, etc.

The methods for treating the light-sensitive silver halide photographic material are not particularly limited, but all treatment methods may be applicable. For example, typical methods include the method in which bleaching fixing treatment is performed after an activator treatment or a color developing treatment, further followed by washing and stabilizing treatments, if desired; the method in which bleaching treatment and fixing treatment are performed separately after a color developing treatment, further followed by washing and stabilizing treatments, if desired; the method in which the treatments are conducted in the order of pre-hardening, neutralization, color development, stopping, fixing, washing with water, bleaching, fixing, washing, post-hardening and washing; the method in which the treatments are conducted in the order of color development, washing, supplemental color development, stopping, bleaching, fixing, washing and stabilization; the developing method in which the developed silver formed by color development is subjected to halogenation bleaching and thereafter subjected again to color development to increase the amount of dyes formed; the method in which a low silver content light-sensitive material is treated with the use of a peroxide or an amplifier agent such as a cobalt complex salt; and so on.

In the following, there are enumerated preferable embodiments of the light-sensitive silver halide photographic materials of this invention and preferable combinations with treatment processes.

A. Light-sensitive Silver Halide Photographic Materials

A-1: Light-sensitive silver halide photographic material including microcapsules containing a developer as core materials.

A-2: Light-sensitive silver halide photographic material including microcapsules containing a developer, a cobalt (III) complex and/or a ruthenium (III) complex as core materials.

A-3: Light-sensitive silver halide photographic material including microcapsules containing a developer, a cobalt (III) complex and/or a ruthenium (III) complex and a silver halide solvent as core materials.

A-4: Light-sensitive silver halide photographic material including microcapsules containing a developer, a cobalt (III) complex and/or a ruthenium (III) complex and hydrogen peroxide as core materials.

A-5: Light-sensitive silver halide photographic material including microcapsules containing a developer, a cobalt (III) complex and/or a ruthenium (III) complex, hydrogen peroxide and a silver halide solvent as core materials.

B. Activator Treating Solutions

B-1: First bath (Activator bath)

An aqueous alkaline solution containing a silver halide solvent.

B-2: First bath (Activator bath)

An aqueous alkaline solution containing a hydrogen peroxide and a silver halide solvent.

B-3: First bath (Activator bath)

An aqueous alkaline solution containing a cobalt (III) complex and/or a ruthenium (III) complex and a silver halide solvent.

B-4: First bath (Activator bath)

An aqueous alkaline solution containing hydrogen peroxide, a cobalt (III) complex and/or a ruthenium (III) complex and a silver halide solvent.

B - 5: First bath (Activator bath)

An aqueous alkaline solution containing a cobalt (III) complex and/or a ruthenium (III) complex.

B - 6: First bath (Activator bath)

An aqueous alkaline solution containing hydrogen peroxide.

B - 7: First bath (Activator bath)

An aqueous alkaline solution.

C. Preferable combinations of preferable embodiments of light-sensitive silver halide photographic materials and treating processes:

| Process | Light-sensitive bath | Activator bath | Fixing bleaching bath |
|---|---|---|---|
| 1 | A-2 | B-1 | None |
| 2 | A-1 | B-2 | None |
| 3 | A-1 | B-5 | Do |
| 4 | A-2 | B-8 | Do |
| 5 | A-1 | B-5 | None |
| 6 | A-2 | B-7 | Do |

It is possible to add various additives into the treating solutions to be used for the light-sensitive silver halide photographic material of this invention, if desired.

The activator bath to be used in this invention may contain other known developer component compounds incorporated therein. For example, as alkali agents, buffer agents, there may be employed caustic soda, caustic potash, sodium carbonate, potassium carbonate, sodium or potassium tertiary phosphate, potassium metaborate, borax, etc. singly or as a combination thereof. For the purpose of providing buffering capacity or convenience in preparation or for the purpose of enhancing the ionic strength, it is also possible to employ various salts such as disodium or dipotassium hydrogen phosphate, potassium or sodium dihydrogen phosphate, sodium or potassium bicarbonate, boric acid, alkali nitrates, alkali sulfates, etc. Any kind of developing accelerators may also be added, if desired.

As a sulfite to be added as preservative, there may be employed sodium sulfite, potassium sulfite, potassium bisulfite, sodium bisulfite, etc. A sulfite may be contained in an amount of 0.5 to 5 g/liter.

Into the activator bath, there may be added any fog preventive agent or development inhibitor, if desired. It can also contain as hard water softener (metal ion chelating agent) a polyphosphoric acid salt such as sodium salts or potassium salts of tripolyphosphoric acid, tetrapolyphosphoric acid, hexametaphosphoric acid, etc. or an aminopolycarboxylic acid such as ethylenediaminetetraacetic acid. Among them, it is preferred to use an aminopolycarboxylic acid for greater effect of reducing color fog. As aminopolycarboxylic acid, there may be employed iminodiacetic acid, 2-aminobenzoic acid-N,N-diacetic acid, aminomethylphosphonic acid-N,N-diacetic acid, nitrilotriacetic acid, N-(hydroxymethyl)ethylenediaminetriacetic acid, N-benzylethylenediaminetriacetic acid, ethylenediaminetetraacetic acid, 1,3-diaminopropanetetraacetic acid, 1,2-diaminopropanetetraacetic acid, 1,3-cyanopropanol(2)-tetraacetic acid, cyclohexane-1,2-diaminetetraacetic acid, glycoletherdiaminetetraacetic acid, diethylether-2,2-diaminetetraacetic acid, diethylenetriaminepentaacetic acid, triethylenetetraminehexaacetic acid, etc. These may be added as alkali salts or ammonium salts thereof. They are used in amounts depending on the hardness of water employed, but usually about 0.5 to 1 g/liter.

For the purpose of increasing the degree of whiteness of the color paper or enhancing stability of the color image to the light, there may also be added into an activator bath an aqueous fluorescent whiteness enhancer such as sodium 4-methyl-7-diethylaminocumalinesulfonate, or it is also possible to employ as a compensating developer p-aminophenol, N-benzyl-p-aminophenol, 1-phenyl-3-pyrazolidone, etc.

This invention is applicable not only for color photography but also for a monochromatic photography in which a black coupler and others are employed.

According to this invention, in a method for forming a dye image in which color developing, image reinforcement, bleaching and fixing are conducted by one-bath treatment of a color photographic element containing a coupler, there can be obtained both of good storage stability of one-bath treating solution and an extremely high color density.

This invention is described in further detail by referring to the following Examples.

EXAMPLE 1

On paper supports laminated with polyethylene, there were coated successively the silver chlorobromide emulsions (silver bromide: 80 mole %) having added the emulsified product of a magenta coupler shown below and the five kinds of developer additives shown below, respectively, and gelatin solutions containing UV-absorbers, and dried to prepare five kinds of samples 1, 2, 3, 4 and 5, respectively.

Emulsified product of magenta coupler

As a magenta coupler, 1-(2,4,6-trichlorophenyl)-3-{2-chloro-5-[1-(octadecyl)succinimido]anilino}-5-pyrazolone was dissolved in a mixture composed of dioctyl phthalate, tricresyl phosphate and ethyl acetate, and the resultant solution was emulsified in an aqueous gelatin solution containing Alkanol B (trade name: an alkyl naphthalene sulfonate, produced by E. I. Du Pont de Nemours & Company).

Preparation of developer additives

Developers were dissolved or dispersed in the aqueous gelatin solutions or polymer solutions as shown in Table 1, followed by addition of distilled water, to obtain D - 1, D - 2 and D - 3.

TABLE 1

| Contents | Developer additive No. D-1 | D-2 | D-3 | D-4 | D-5 |
|---|---|---|---|---|---|
| 12% aqueous gelatin solution | 40 ml | 40 ml | 40 ml | Microcapsules shown below | Microcapsules shown below |
| Distilled water | 20 ml | 20 ml | 100 ml | | |
| Developing agent or its precursor | Exemplary compound-1 0.6 g | Exemplary compound-2 0.8 g | Exemplary compound-2 0.8 g | | |
| 10.8% aqueous polymer solution* (adjusted to pH 7.0) | — | — | 10 ml | | |

*polymer composition: n-isopropylacrylamide/sodium 3-methacroyloxy-propane-1-sulfonate/2-acetoacetoxyethyl methacrylate = 70/20/10 (wt. %).

Next, the process for preparing the microcapsules D - 4 and D - 5 of this invention are shown below.

D - 4

In 80 ml of n-hexane were dissolved 12.0 g of sulfosuccinic acid bis-2-ethylhexyl ester sodium salt and 6.0 g of polyoxyethylene-4-lauryl ether. Then, a solution of 13 g of the exemplary compound-1 dissolved in 40 ml of distilled water was added slowly into the resultant solution, followed by sufficient stirring. The solution on completion of mixing was transferred into a cylindrical double-walled reactor. As the next step, under sufficient stirring, 0.1 g of N,N'-methylenebisacrylamide and 10 g of methacrylic acid were added, followed further by addition of 5 mg of sodium riboflavin-5'-phosphate and 1 mg of potassium persulfate to be dissolved therein. And, under continuous stirring, in an nitrogen atmosphere at a temperature of 35°±5° C., light irradiation was effected for 7 to 10 hours until the monomers disappear. The thus produced microcapsule suspension was brought to a condition under reduced pressure to evaporate n-hexane, followed by isolation of capsules by centrifugation. The microcapsule particles obtained had sizes of 100 to 300 nm.

D - 5

Synthesis was performed in the same manner as in preparation of D - 4 except for using the exemplary compound-2 in place of the exemplary compound-1 to obtain D - 5.

Exemplary compound - 1

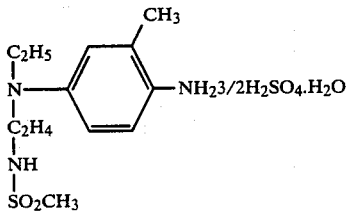

Exemplary compound - 2

-continued

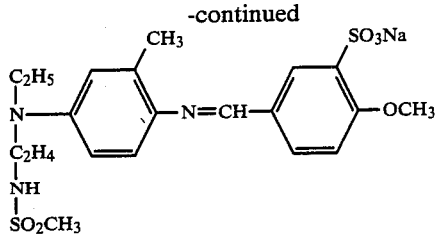

The amounts of silver halides coated in these samples were each 3.0 mg per 100 cm$^2$ (calculated as silver). The color developer was employed in an amount equimolar to the silver quantity and the coupler was coated in an amount at a proportion stoichiometrically greater by 40% or more than silver.

These samples were stored in the air at 55° C. for 2 days for forced deterioration tests, then subjected to white light exposure similarly as unforced deterioration samples thorugh a step-wedge, followed by application of the following process.

Processing steps

| | | |
|---|---|---|
| Activator developing | 50° C. | one minute |
| Bleaching fixing | 50° C. | one minute 30 seconds |
| Washing | 50° C. | two minutes |
| Stabilizing | 50° C. | one minute |

TREATING SOLUTIONS

Activator solution

| | |
|---|---|
| Benzyl alcohol | 14 ml |
| Sodium sulfite | 2 g |
| Potassium bromide | 0.5 g |
| Hexamine cobalt-trichloride | 20 g |
| Sodium carbonate (monohydrate) | 30 g |
| Make up to one liter with addition of water and adjust to pH 10.1 | |

Bleach-fix solution

| | |
|---|---|
| Ammonium thiosulfate (70%) | 150 ml |
| Sodium sulfite | 5 g |
| Na[Fe(III)(EDTA)] | 40 g |
| EDTA | 4 g |
| Made up to one liter with addition of water (EDTA: ethylenediaminetetraacetic acid) | |

Stabilizing solution

| | |
|---|---|
| Glacial acetic acid | 10 ml |
| Sodium acetate | 5 g |
| Formalin (37%) | 5 ml |
| Make up to one liter with addition of water | |

TABLE 2

| | Developing agent or its precursor | On the same day Fog | Relative sensitivity | Max. density | After forced deterioration Fog | Relative sensitivity | Max. density |
|---|---|---|---|---|---|---|---|
| 1 | D-1 | 0.25 | 100 | 1.28 | 0.30 | 70 | 0.80 |
| 2 | D-2 | 0.10 | 150 | 1.72 | 0.25 | 105 | 1.10 |

TABLE 2-continued

| | Developing agent or its precursor | On the same day | | | After forced deterioration | | |
|---|---|---|---|---|---|---|---|
| | | Fog | Relative sensitivity | Max. density | Fog | Relative sensitivity | Max. density |
| 3 | D-3 | 0.08 | 160 | 1.82 | 0.20 | 100 | 1.25 |
| 4 | D-4 | 0.06 | 200 | 2.30 | 0.07 | 195 | 2.28 |
| 5 | D-5 | 0.05 | 205 | 2.32 | 0.08 | 200 | 2.29 |

(Note)
Relative sensitivity is shown in terms of the value relative to the sensitivity of Sample 1 on the same day as 100.

As apparently seen from Table 2, Sample 4 and Sample 5 of this invention are markedly excellent in photographic performances on the same day and after forced deterioration as compared with Control samples 1, 2 and 3. These results also indicate that this invention provides a light-sensitive silver halide photographic material excellent in storage stability corresponding to rapid processing.

EXAMPLE 2

The treatment was carried out in the same manner as in Example 1 except that 4.0 ml of a hydrogen peroxide (30%) was added to the activator solution. As the result, it was found that this invention is remarkably lower in lowering of sensitivity and in lowering of the maximum density even under forced deterioration conditions as compared with Controls. Also, it was found that the amplifying effect by the co-presence of a cobalt (III) complex and hydrogen peroxide was also effective to give a light-sensitive silver halide photographic material of the silver-saving type excellent in storability.

EXAMPLE 3

On paper supports laminated with polyethylene, there were provided by coating silver chlorobromide emulsions (mean grains size: 0.3μ) having incorporated, similarly as in Example 1, 1-(2,4,6-trichlorophenyl)-3-{2-chloro-5-[1-(octadecyl)succinimido]anilino}-5-pyrazolone in orthotricresylphosphate to amounts of 90 mole % relative to silver, and having also added the cobalt (III) ion complex dispersions—1 and 2, respectively, so that the silver quantity was 2 mg/dm$^2$ and the cobalt quantity 23 mg/dm$^2$, followed successively by provision of a gelatin layer containing a UV-absorber, to prepare Samples 6 and 7. Control sample 8 containing no cobalt (III) was also prepared similarly as the above procedure.

Cobalt (III) ion complex dispersion

Dispersion - 1

$[Co(NH_3)_6](CH_3COO)_3$ was dispersed in an aqueous gelatin solution.

Dispersion - 2 (microcapsule suspension)

In 80 ml of n-hexane were dissolved 12.0 g of sulfosuccinic acid bis-2-ethylhexylester sodium salt and 6.0 g of polyoxyethylene-4-lauryl ether. Then, into the resultant solution, a solution having 13 g of $[Co(NH_3)_6](CH_3COO)_3$ dissolved in 40 ml of distilled water was added slowly and thereafter the mixture was sufficiently stirred. On completion of mixing, the solution obtained was transferred into a cylindrical double-walled reactor. Next, under sufficient stirring, 0.1 g of N,N'-methylenebisacrylamide and 10 g of methacrylic acid were added and further 5 mg of sodium riboflavin-5'-phosphate and 1 mg of potassium sulfate were dissolved in the mixture. And, under continuous stirring, the mixture was subjected to light irradiation under nitrogen atmosphere at a temperature of 35°±5° C. for 7 to 10 hours until the monomers disappear. The microcapsule solution thus produced was placed under reduced pressure for evaporation of n-hexane, then the surfactant was removed by ultrafiltration with addition of water, followed further by isolation of capsules by centrifugation. The microcapsule particles obtained had sizes of 100 to 300 nm.

The above Samples 6 and 7 were exposed to light through a step-wedge and then subjected to the following processes.

Processing steps

| | | |
|---|---|---|
| Developing | 40° C. | one minute |
| Bleaching fixing | 40° C. | one minute |
| Washing | 40° C. | two minutes |
| Stabilizing | 40° C. | one minute |

TREATING SOLUTIONS

Developing solution

| | |
|---|---|
| Benzyl alcohol | 15 ml |
| Potassium bromide | 0.5 g |
| Potassium sulfite | 4.0 g |
| Hydroxylamine sulfate | 2.0 g |
| 4-amino-3-methyl-(N—ethyl-N—β-ethoxyethyl)aniline-di-p-toluenesulfonate diamino-propanoltetraacetic acid | 5.0 g |
| Potassium carbonate | 30.0 g |
| Make up to one liter with addition of water and adjust to pH 10.1 | |

The same bleach-fix solution and stabilizing solution as used in Example 1 were employed.

After the treatment, Sample 6 exhibited substantially no fog, but exhibited lowering in sensitivity by 1.5 log E as compared with Sample 8. Sample 7 of this invention exhibited sensitivity substantially the same as that of Sample 8, thus proving that this invention has excellent effects.

EXAMPLE 4

On a paper support laminated with polyethylene, the following layers were successively provided by coating in the order shown below to prepare Samples 9, 10 and 11.

Layer - 1: Blue-sensitive silver halide emulsion layer

A dispersion of a yellow coupler of α-pivalyl-4-(4-benzyl-oxyphenylsulfonyl)phenoxy-2-chloro-5-[γ-(2,4-di-t-amylphenoxy)butylamido] acetanilide in di-n-butyl phthalate was added to a blue-sensitive silver chlorobromide emulsion and the mixture was coated to a silver quantity of 1.5 mg/dm$^2$ (coupler 6.5 mg/dm$^2$) and a gelatin quantity of 13 mg/dm$^2$.

Layer - 2: Gelatin layer

Gelatin was coated to an amount of 10.8 mg/dm$^2$.

Layer - 3: Green-sensitive silver halide emulsion layer

A dispersion of a magenta coupler of 1-(2,4,6-trichlorophenyl)-3-{5-[α-(3-t-butyl-4-hydroxyphenoxy)- tetradecaneamido]-2-chloroanilino}-5-pyrazolone in tricresyl phosphate was added to a green-sensitive silver chlorobromide emulsion and the mixture was coated to a silver quantity of 1.0 mg/dm$^2$ (coupler 2.7 mg/dm$^2$) and a gelatin quantity of 14 mg/dm$^2$.

Layer - 4: Gelatin layer

Gelatin was coated to an amount of 17 mg/dm$^2$.

Layer - 5: Red-sensitive silver halide emulsion layer

A dispersion of a cyan coupler of 2-[α-(2,4-di-t-amylphenoxy)butylamido]-4,6-dichloro-5-methylphenol in di-n-butyl phthalate was added to a red-sensitive silver chlorobromide emulsion and the mixture was coated to a silver quantity of 0.7 mg/dm$^2$ (coupler 4.0 mg/dm$^2$) and a gelatin quantity of 9.7 mg/dm$^2$.

Layer - 6: Protective layer

Gelatin (10.8 mg/dm$^2$) and a UV-absorber of Tinuvin 320 (trade name: produced by Ciba-Geigy Co.) having the following formula:

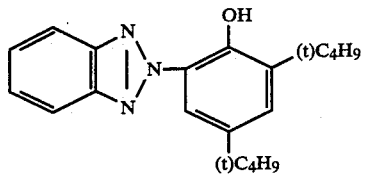

(4 mg/dm$^2$) were coated. This is called as Sample 9.

Sample 10

Sample 10 was prepared in the same manner as Sample 9 except that D - 3 of Example 1 was added to an amount of the developing agent precursor equimolar to silver and the cobalt (III) ion complex dispersion-1 of Example 3 to an amount of cobalt equimolar to silver in respective emulsion layers in Sample 9.

Sample 11

Sample 11 was prepared in the same manner as Sample 9 except that D - 4 of Example 1 was added to an amount of the developing agent precursor equimolar to silver and the cobalt (III) ion complex dispersion-2 of Example 3 to an amount of cobalt equimolar to silver in respective emulsion layers in Sample 9.

These samples were stored in the air at 55° C. for 2 days for forced deterioration tests, then subjected to white light exposure similarly as unforced deterioration samples through a step-wedge, followed by application of the following processes.

Processing steps

| | | |
|---|---|---|
| Activator developing | 40° C. | one minute |
| Bleaching fixing | 40° C. | one minute |
| Stabilizing | 40° C. | one minute |

Activator solution composition

| | |
|---|---|
| Benzyl alcohol | 14 ml |
| Sodium sulfite | 2.0 g |
| Potassium bromide | 0.5 g |
| Sodium carbonate (monohydrate) | 30.0 g |
| Make up to one liter with addition of water and | |

-continued

| |
|---|
| adjust to pH 12.0 |

The same bleach-fix solution and the stabilizing solution as used in Example 1 were employed.

Sample 11 of this invention exhibited higher photographic performance in sensitivity and the maximum density as compared with Sample 9 and Sample 10.

Also, as shown in this Example, in spite of the short time treatment, Sample 11 of this invention was found to be free from reduction in sensitivity and generation of fog and contamination, and also improved in reduction of sensitivity and photographic density during storage.

EXAMPLE 5

Samples 9, 10 and 11 prepared in Example 4 were treated in the same manner as in Example 1, except that 4.0 moles of a hydrogen peroxide (30%) was added to the activator solution. As the result, the amplifying effect by the co-presence of hydrogen peroxide of this invention was found to be effective, thus providing a light-sensitive silver halide photographic material of the silver-saving type which is excellent in storability.

We claim:

1. A light-sensitive silver halide photographic material, comprising a support having thereon at least one hydrophilic colloid layer containing microcapsules having a mean particle size of up to 5μ, said microcapsules comprising a wall made of a material which can be dissolved at a pH of at least 7, and a photographic treating reagent encapsulated within said wall material.

2. The light-sensitive silver halide photographic material according to claim 1, wherein said treating agent is a reducing agent, an oxidizing agent or a silver halide solvent.

3. The light-sensitive silver halide photographic material according to claim 2, wherein said reducing agent is a developing agent or a precursor thereof.

4. The light-sensitive silver halide photographic material according to claim 3, wherein said developing agent or precursor thereof is an aromatic primary amine color developing agent or a precursor thereof.

5. The light-sensitive silver halide photographic material according to claim 2, wherein said oxidizing agent is selected from the group consisting of a cobalt (III) complex, a ruthenium (III) complex and a peroxide.

6. The light-sensitive silver halide photographic material according to claim 5, wherein said cobalt (III) complex is a coordinated complex of cobalt having ligands selected from the group consisting of amine, ethylenediamine, diethylenetriamine, triethylenetetramine, nitrate, nitrite, azide, chloride, thiocyanate, isothiocyanate, sepulchrate, water and carbonate, and said complex having at least five amine ligands or at least two ethylenediamine ligands.

7. The light-sensitive silver halide photographic material according to claim 5, wherein said peroxide is a water soluble compound containing a peroxy group (—O—O—).

8. The light-sensitive silver halide photographic material according to claim 5, wherein said peroxide is hydrogen peroxide.

9. The light-sensitive silver halide photographic material according to claim 2, wherein said silver halide solvent is at least one selected from the group consisting of a water soluble thiosulfate, a thiourea, an ethylenethiourea, a water soluble thiocyanate, a water soluble sulfur containing diol and a water soluble sulfur containing dibasic acid.

10. The light-sensitive silver halide photographic material according to claim 9, wherein said water soluble sulfur containing diol is a compound represented by the formula:

$$HO(CH_2CH_2Z)_pCH_2CH_2OH$$

in which p is an integer of 2 to 13, Z represents an oxygen atom or a sulfur atom, wherein at least ⅓ of the Z atoms are sulfur atoms and wherein at least two adjacent atoms represented Z are sulfur atoms.

11. The light-sensitive silver halide photographic material according to claim 9, wherein said water soluble sulfur containing dibasic acid is a compound represented by the formula:

$$HOOCCH_2—(SCH_2CH_2)_qSCH_2COOH$$

in which q is an integer of 1 to 3, and alkali metal salts and ammonium salts thereof.

12. The light-sensitive silver halide photographic material according to claim 1, wherein said wall material is at least one polymer selected from the group consisting of a vinyl polymer having pendant carboxyl groups, a vinyl polymer having pendant sulfonic acid groups and a condensation type polymeric compound.

13. The light-sensitive silver halide photographic material according to claim 12, wherein said vinyl polymer is a copolymer of a first monomer selected from the group consisting of methacrylic acid, acrylic acid and sulfonic acid, with a second monomer selected from the group consisting of methacrylates, styrenes and vinyl ketones.

14. The light-sensitive silver halide photographic material according to claim 12, wherein said condensation type polymeric compound is selected from the group consisting of condensates of lysine with polycarboxylic acid chlorides.

15. The light-sensitive silver halide photographic material according to claim 3, wherein the developer is employdd in an amount of from 0.15 to 1.5 mole per mole of silver halide.

16. The light-sensitive silver halide photogrpahic material according to claim 5, wherein the cobalt (III) complex is employed in an amount of 0.075 to 4.0 moles of cobalt per mole of silver.

17. The light-sensitive silver halide photographic material according to claim 5, wherein said silver halide photographic material contains a silver halide emulsion and said peroxide is employed in an amount of 0.001 mole to 0.5 mole per liter of said silver halide emulsion.

18. The light-sensitive silver halide photographic material according to claim 9, wherein said water soluble sulfur containing diol is a compound represented by the formula:

$$HO\text{-}\overline{(CH_2CH_2X)_{c-1}}\overline{(CH_2CH_2X')_{d-1}}\overline{(CH_2CH_2X)_{e-1}}\overline{(CH_2CH_2X')_{f-1}}\overline{(CH_2CH_2X)_{g-1}}CH_2C\text{-}H_2OH$$

wherein X and X′ each represent oxygen or sulfur, and when X is oxygen, X′ is sulfur, and when X is sulfur, X′ is oxygen; each of c, d, e, f and g is an integer of 1 to 15, and the total of c+d+e+f+g is an integer of 6 to 19; at least ⅓ of the total atoms represened by X and X′ are sulfur atoms; and wherein at least two adjacent atoms represented by X, X′ and X, and X′ are sulfur atoms.

19. The light-sensitive silver halide photographic material according to claim 2, wherein said silver halide solvent is employed in an amount of 2 to 5 equivalents relative to the amount of silver halide.

20. The light-sensitive silver halide photographic material according to claim 1, wherein the mean particle size of said microcapsules is up to 0.5μ.

* * * * *